United States Patent [19]

Palmatier et al.

[11] Patent Number: 5,048,810

[45] Date of Patent: Sep. 17, 1991

[54] APPARATUS FOR ADJUSTING AN ANGLEBAR OR A COMPENSATOR ROLLER IN A FOLDER OF A PRINTING PRESS

[75] Inventors: Roland T. Palmatier, Durham; Glenn A. Guaraldi, Kingston, both of N.H.

[73] Assignee: Harris Graphics Corporation, Dover, N.H.

[21] Appl. No.: 615,219

[22] Filed: Nov. 19, 1990

[51] Int. Cl.[5] ..... B65H 39/00

[52] U.S. Cl. ..... 270/52; 270/10; 270/18; 270/43; 270/19; 226/197; 226/199

[58] Field of Search ..... 270/5, 10, 18, 19, 41, 270/43, 44, 52; 266/199, 197, 174, 179, 16, 18

[56] References Cited

U.S. PATENT DOCUMENTS

| | | | |
|---|---|---|---|
| 2,506,053 | 5/1950 | Zuckerman | 270/18 |
| 3,556,509 | 1/1971 | Crum | 270/52 |
| 3,679,116 | 7/1972 | Hamlin | 226/199 |
| 3,734,487 | 5/1973 | Treff | 270/10 |
| 4,155,496 | 5/1979 | Houck | 226/197 |

FOREIGN PATENT DOCUMENTS

| | | | |
|---|---|---|---|
| 2586097 | 2/1987 | France | 270/5 |
| 179346 | 10/1984 | Japan | 226/197 |
| 75562 | 3/1990 | Japan | 226/197 |

*Primary Examiner*—Edward K. Look
*Assistant Examiner*—Therese M. Newholm
*Attorney, Agent, or Firm*—Tarolli, Sundheim & Covell

[57] ABSTRACT

An anglebar and/or a compensator roller in a folder of a printing press is adjustable. A motor has an output shaft operatively connected with the anglebar and/or the compensator roller to, when driven, adjust the position of the anglebar and/or the compensator roller. A tachometer provides a speed reference signal indicative of the speed of movement of a web of sheet material relative to the anglebar and/or the compensator roller. A web position sensor provides an adjustment control signal indicating that the anglebar and/or the compensator roller should be adjusted. A computer responds to the speed reference signal and the adjustment control signal to control a DC drive. The DC drive drives the motor at a speed which varies with the speed of movement of the web of sheet material. The anglebar and/or the compensator roller is thereby moved to a desired position at a rate which is a function of the speed of movement of the web of sheet material relative to the anglebar and/or the compensator roller.

8 Claims, 2 Drawing Sheets

APPARATUS FOR ADJUSTING AN ANGLEBAR OR A COMPENSATOR ROLLER IN A FOLDER OF A PRINTING PRESS

TECHNICAL FIELD

The present invention relates to an apparatus including an electric motor which, when actuated, adjusts the position of an anglebar and/or a compensator roller in a folder of a printing press.

BACKGROUND ART

As is known in a folder of a printing press, a web of sheet material after being printed thereon can be slit lengthwise into ribbons which are associated or interleaved before being folded, cut, and delivered as signatures. An arrangement of compensator rollers either lengthens or shortens the travel distance of the web of sheet material. The compensator rollers control the lengthwise location of the web of sheet material for accurate association of its ribbons to thereby assure uniform head and tail margins and accurate cut-off.

An arrangement of anglebars associates the ribbons one on top of the other before they are folded, cut, and delivered as signatures. Anglebars are hard smooth metal members around which a web of sheet material slides. The anglebars change the direction of travel of the web of sheet material and can be adjusted angularly as well as lengthwise of the direction of web travel. When an anglebar is adjusted lengthwise of the direction of web travel, the anglebar acts like a compensator roller to lengthen and shorten the travel distance of a web of sheet material.

The use of an electric motor for adjusting an anglebar and/or a compensator roller in a folder of a printing press is well known. The known adjustment of the anglebar and/or the compensator roller is relatively slow and at a constant rate at all operating speeds of the printing press. If the adjustment is made at a fast rate, a break in the web of sheet material may occur under certain circumstances.

SUMMARY OF THE INVENTION

It has been discovered that the rate of adjustment of an anglebar and/or a compensator roller in a folder of a printing press can be increased as the speed of movement of a web of sheet material through the printing press is increased without the occurrence of a break in the web of sheet material Thus, the anglebar and/or the compensator roller can be adjusted at a faster rate when the speed of movement of the web of sheet material through the printing press is at a faster speed.

An apparatus for adjusting the position of an anglebar and/or a compensator roller both of which guide a moving web of sheet material in a folder of a printing press comprises a motor having an output shaft operatively connected with the anglebar and/or the compensator roller to, when driven, adjust the position of the anglebar and/or the compensator roller. A means provides a speed reference signal indicative of the speed of movement of the web of sheet material relative to the anglebar and/or the compensator roller. Also, a means provides an adjustment control signal indicating that the anglebar and/or the compensator roller should be adjusted. Motor control means responsive to the speed reference signal and the adjustment control signal drives the motor at a speed which varies with the speed of movement of the web of sheet material.

When the web of sheet material is moving at a slow speed, the motor is driven at a relatively slow speed to move the anglebar and/or the compensator roller to a desired position at a relatively slow rate. When the web of sheet material is moving at a fast speed, the motor is driven at a relatively fast speed to move the anglebar and/or the compensator roller to the desired position at a relatively fast rate. The anglebar and/or the compensator roller is therefore moved to the desired position at a rate which is a function of the speed of movement of the web of sheet material relative to the anglebar and/or the compensator roller.

BRIEF DESCRIPTION OF THE DRAWINGS

The foregoing and other features and advantages of the present invention will become apparent to one skilled in the art to which the present invention relates from reading the following description of a preferred embodiment of the present invention in conjunction with the accompanying drawings, wherein.

DETAILED DESCRIPTION OF A PREFERRED EMBODIMENT

The present invention is directed to an apparatus for adjusting the position of an anglebar and/or a compensator roller in a folder of a printing press during operation of the printing press. The present invention may be used in folders of different constructions. The description below is merely an example of one application of the present invention to one type of folder.

Figure 1:
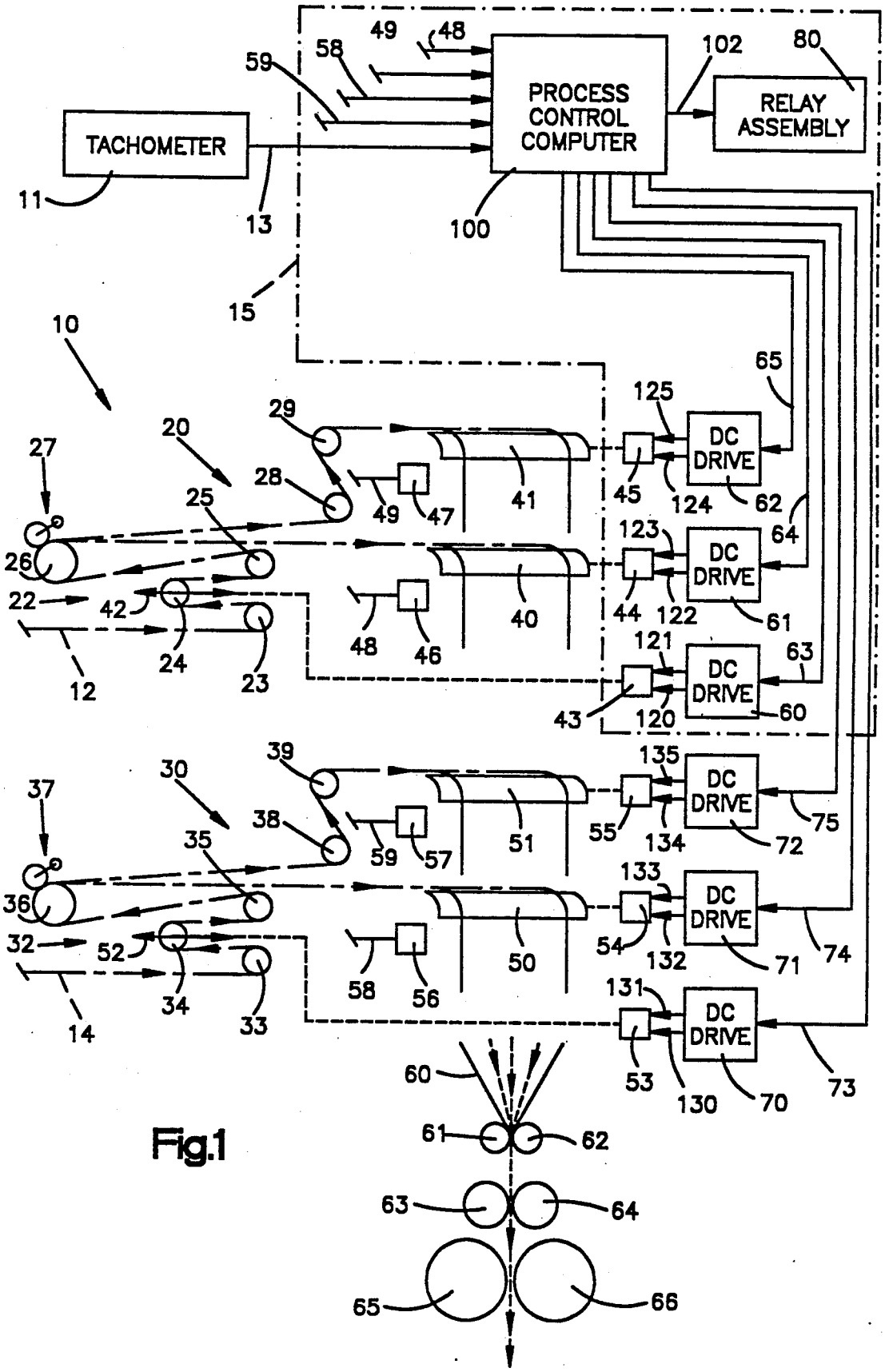
FIG. 1 is a schematic block diagram of a folder of a printing press incorporating a control apparatus constructed in accordance with the present invention.

Referring to FIG. 1, a folder 10 of a printing press has a number of folder sections. As shown in FIG. 1, only two folder sections 20, 30 are shown. Although only two folder sections are shown in FIG. 1, it is understood that a different number of folder sections may be incorporated into the folder 10. The folder sections 20, 30 have respective adjustable compensators 22, 32. Each of the compensators 22, 32 includes a plurality of compensator rollers. The compensator 22 includes three compensator rollers 23, 24, 25 and the compensator 32 includes three compensator rollers 33, 34, 35.

Each of the folder sections 20, 30 also includes respective driven lead rollers 26, 36 and respective slitter assemblies 27, 37. The driven lead rollers 26, 36 and their respective slitter assemblies 27, 37 define respective nips therebetween. Each nip is provided for receiving a web of sheet material. A web 12 of sheet material is wrapped around the three compensator rollers 23, 24, 25 and then directed through the nip defined between the driven lead roller 26 and the slitter assembly 27. Similarly, a web 14 of sheet material is wrapped around the three compensator rollers 33, 34, 35 and then directed through the nip defined between the driven lead roller 36 and the slitter assembly 37. The folder section 20 includes a pair of non-driven lead rollers 28, 29 and a pair of anglebars 40, 41. Similarly, the folder section 30 includes a pair of non-driven lead rollers 38, 39 and a pair of anglebars 50, 51.

The folder 10 further includes a former board 60 for receiving and associating ribbons and a pair of nip rollers 61, 62 located below the former board 60. A pair of cut-off rollers 63, 64 and a pair of folding cylinders 65, 66 located below the pair of cut-off rollers 63, 64 are located below the pair of nip rollers 61, 62. The ribbons from the anglebars 40, 41, 50, 51 are folded longitudinally as they pass over the former board 60 and between the nip rollers 61, 62. The ribbons after being longitudinally folded are cut transversely by the cut-off rollers 63, 64. The cut-off portions of the ribbons are then folded transverse to their direction of movement by the folding cylinders 65, 66. This structure and its operation are well known and, therefore, will not be described in detail.

The folder sections 20, 30 have a tachometer 11 to indicate the speed of movement of the webs 12, 14 through the folder sections 20, 30. The speed of movement of the web 12 of sheet material through the folder section 20 is the same as the speed of movement of the web 14 of sheet material through the folder section 30. The tachometer 11 could be mounted anywhere including on a common drive shaft of printing units associated with one of the folder sections 20, 30. The tachometer 11 provides a control signal on line 13 indicative of the speed of movement of the webs 12, 14 of sheet material. Each of the compensator rollers 24, 34 rotates at a speed functionally related to the speed of movement of the webs 12, 14 of sheet of material through the folder sections 20, 30.

The compensator rollers 24, 34 have respective DC motors 43, 53 associated therewith. Each of the DC motors 43, 53 has an output shaft operatively associated with the corresponding one of the compensator rollers 24, 34. Each of the DC motors 43, 53, when energized, adjusts the position of the corresponding one of the compensator rollers 24, 34 relative to the corresponding other two compensator rollers, as is known. More specifically, as shown in FIG. 1, the compensator roller 24 is linearly adjustable in the direction of the arrows 42 relative to the two compensator rollers 23, 25. The compensator roller 34 is linearly adjustable in the direction of the arrows 52 relative to the two compensator rollers 33, 35.

The anglebars 40, 41, 50, 51 have respective DC motors 44, 45, 54, 55 associated therewith. Each of the DC motors 44, 45, 54, 55 has an output shaft operatively associated with the corresponding one of the anglebars 40, 41, 50, 51. Each of the DC motors 44, 45, 54, 55, when actuated, adjusts the lengthwise position or the angular position of the corresponding one of the anglebars 40, 41, 50, 51.

The folder 10 includes a control system having some means for indicating the need for adjustment. In the illustrated embodiment, a sensor for sensing web position is used. Specifically, the anglebars 40, 41, 50, 51 have respective web position sensors 46, 47, 56, 57 for sensing position marks printed onto the associated ribbons, as is known. Each of the web position sensors 46, 47, 56, 57 provides a respective position signal on a respective signal line. The position signal from the web position sensor 46 is on a signal line 48, the position signal from the web position sensor 47 is on a signal line 49, the position signal from the web position sensor 56 is on a signal line 58, and the position signal from the web position sensor 57 is on a signal line 59. As shown in FIG. 1, the four signals on lines 48, 49, 58, 59 are connected to a process control computer 100.

The DC motors 43, 44, 45, 53, 54, 55 have respective DC drives 60, 62, 67, 70, 71, 72. Each of the DC drives 60, 61, 62, 70, 71, 72 has a pair of DC output power lines connectable with the corresponding one of the DC motors 43, 44, 45, 53, 54, 55. A pair of DC output power lines 120, 121 is connectable with the motor 43, a pair of DC output power lines 122, 123 is connectable with the motor 44, and a pair of DC output power lines 124, 125 is connectable with the motor 45. Similarly, a pair of DC output power lines 130, 131 is connectable with the motor 53, a pair of DC output power lines 132, 133 is connectable with the motor 54, and a pair of DC output power lines 134, 135 is connectable with the motor 55.

The computer 100 provides a speed control signal on signal line 63 to the DC drive 60 to control the application of the DC output power to power lines 120, 121, a speed control signal on signal line 64 to the DC drive 61 to control the application of the DC output power to power lines 122, 123, and a speed control signal on signal line 65 to the DC drive 62 to control the application of the DC output power to power lines 124, 125. Similarly, the computer 100 provides a speed control signal on signal line 73 to the DC drive 70 to control the application of the DC output power to power lines 130, 131, a speed control signal on line 74 to the DC drive 71 to control the application of the DC output power to power lines 132, 133, and a speed control signal on line 75 to the DC drive 72 to control the application of the DC output power to power lines 134, 135.

Figure 2:
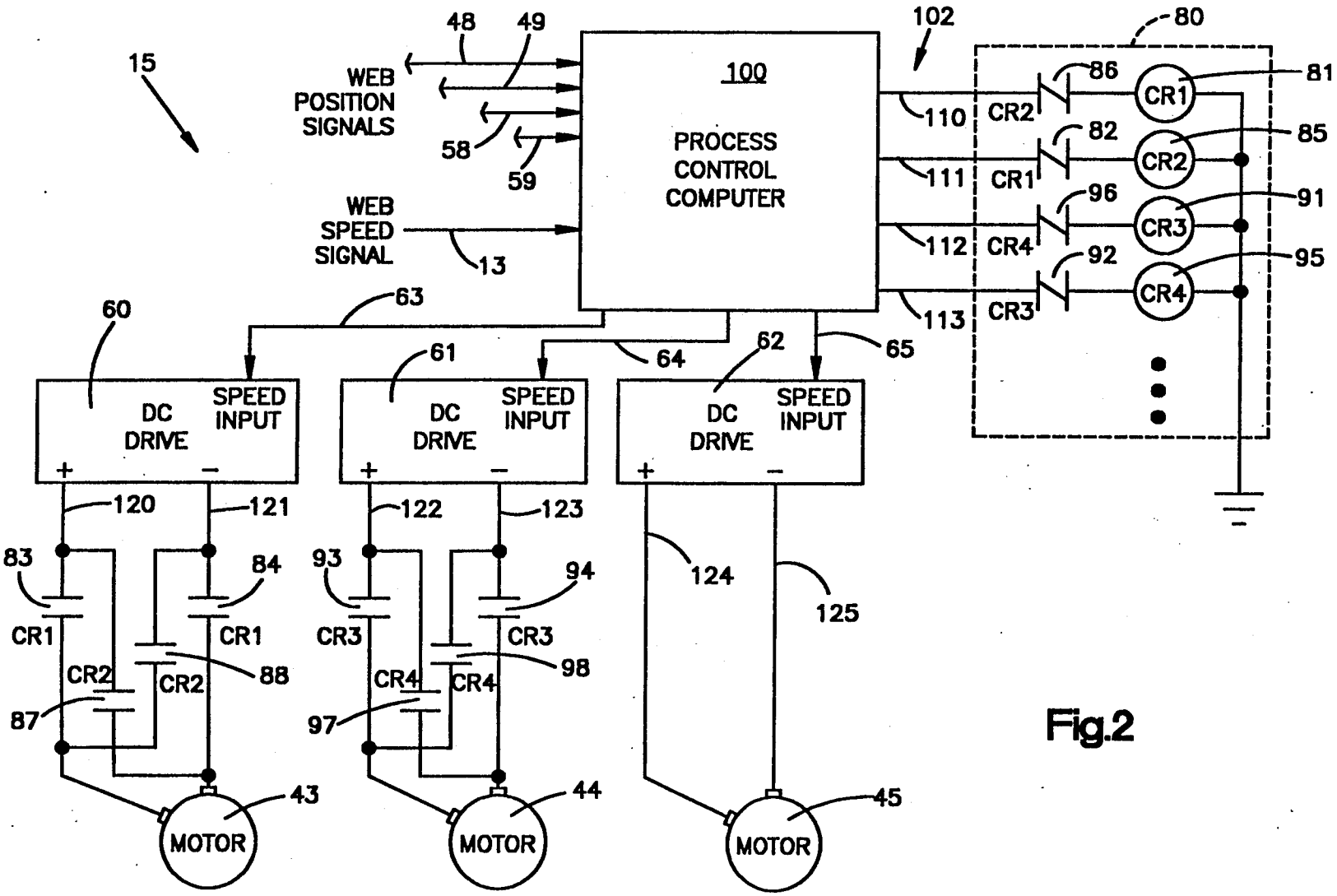
FIG. 2 is a detailed view of a portion of the control apparatus of FIG. 1.

The computer 100 also provides control signals on signal line 102 to a relay assembly 80. Referring to FIG. 2, the relay assembly 80 has a number of energizeable relays which are energized and deenergized in response to the control signals on line 102 from the computer 100. As shown in FIG. 2, only four relays 81, 85, 91, 95 are shown. Two relays are associated with controlling one DC motor. The two relays 81, 85 are associated with controlling the motor 43 which, in turn, is associated with the compensator roller 24. The two relays 91, 95 are associated with controlling the motor 44 which, in turn, is associated with the anglebar 40. Although only four relays are shown in FIG. 2, it is understood that the number of relays needed depends upon the number of DC motors used in the folder 10.

The computer 100 receives input signals and processes the input signals in accordance with a preprogrammed procedure stored in the internal memory of the computer 100. As shown in FIG. 1, the control signals on lines 63, 64, 65, 73, 74, 75 and the control signals on line 102 are generated in accordance with a preprogrammed procedure stored in the internal memory of the computer 100 in response to the signals on line 13 from the tachometer 11 and the signals on lines 48, 49, 58, 59 from the web position sensors 46, 47, 56, 57. Computers are readily available in the commercial market. Their internal structure and operation are well known in the art and, therefore, the computer 100 will not be described in detail herein.

Referring to FIG. 2, a portion 15 of FIG. 1 is shown. The line 102 includes a signal line 110 connected between the computer 100 and one side of a normally-closed contact set 86 of the relay 85 (CR2). The line 102 also includes a line 111 connected to one side of a normally-closed contact set 82 of the relay 81 (CR1). The line 102 also includes a signal line 112 connected between the computer 100 and one side of a normally-closed contact set 96 of the relay 95 (CR4). A signal line 113 is connected between the computer 100 and one side of a normally-closed contact set 92 of the relay 91 (CR3).

Each of the relays 81, 85, 91, 95 has one coil terminal connected to ground on line 99. The other coil terminal of the relay 81 is connected to the other side of the contact set 86 of the relay 85. The other coil terminal of the relay 85 is connected to the other side of the contact set 82 of the relay 81. The other terminal of the relay 91 is connected to the other side of the contact set 96 of the relay 95. The other terminal of the relay 95 is connected to the other side of the contact set 92 of the relay 91.

A contact set 83 and a contact set 84 are associated with the relay 81. A contact set 87 and a contact set 88 are associated with the relay 85. A contact set 93 and a contact set 94 are associated with the relay 91. A contact set 97 and a contact set 98 are associated with the relay 95. The structure and operation of the pair of relays 91, 95 are the same as that of the pair of relays 81, 85. Since the structure and operation of the relays 91, 95 are the same as that of the relays 81, 85, only the structure and operation of the relays 81, 85 associated with the motor 43 will be described in detail.

One side of the contact set 83 is connected to the power on line 120 and the other side of the contact set 83 is connected to the positive terminal of the motor 43. One side of the contact set 84 is connected to the power on line 121 and the other side of the contact set 84 is connected to the negative terminal of the motor 43. One side of the contact set 87 is connected to the power on line 120 and the other side of the contact set 87 is connected to the negative terminal of the motor 43. One side of the contact set 88 is connected to the power line 121 and the other side of the contact set 88 is connected to the positive terminal of the motor 43.

The contact sets 82, 83, 84 associated with the relay 81 and the contact sets 86, 87, 88 associated with the relay 85 are arranged and interconnected so that the energization of either the relay 81 or the relay 85 prevents energization of the other relay not energized. For example, if a signal is on line 110 which energizes the relay 81, the contact set 82 opens so that the relay 85 cannot be energized. Similarly, if a signal is on line 111 which energizes the relay 85, the contact set 86 opens so that the relay 81 cannot be energized.

When the relay 81 is energized, the contact sets 83, 84 are closed and the contact sets 87, 88 are open. When the contact sets 83, 84 of the relay 81 are closed, the motor 43 operates so that its output shaft rotates in one direction. When the relay 85 is energized, the contact sets 87, 88 are closed and the contact sets 83 and 84 are open. When the contact sets 86, 87 of the relay 85 are closed, the motor 43 operates so that its output shaft rotates in the opposite direction.

The computer 100 monitors the signals on line 13 from the tachometer 11 and the signals on lines 48, 49, 58, 59 from the web position sensors 46, 47, 56, 57. The computer 100 generates the control signals on lines 63, 64, 65, 73, 74, 75 to control the DC drives 60, 61, 62, 70, 71, 72, respectively, in response to the signal on line 13 from the tachometer 11 and the signals on lines 48, 59, 58, 59 from the web position sensors 46, 47, 56, 57. The computer 100 also generates the control signals on line 102 to control the relays in the relay assembly 80.

With specific regard to operation of the motor 43, the control signal on line 110 and the control signal on line 111 are provided by the computer 100 in response to the signal on line 13 from the tachometer 11 and the signals on lines 48, 49, 58, 59 from the web position sensors 46, 47, 56, 57. As previously mentioned, the computer 100 also generates the speed control signal on line 63 in response to the signal on line 13 and the signals on lines 48, 49, 58, 59. The DC drive 60 applies the DC output power on lines 120, 121 in accordance with the control signal on line 63. The DC output power on lines 120, 121 varies as a function of the speed of movement of the webs 12, 14 through the folder sections 20, 30 as indicated on line 13 and the web position signals as indicated on lines 48, 49, 58, 59.

Since the DC output power applied on lines 120, 121 varies as a function of the speed of movement of the webs 12, 14 through the folder sections 20, 30, the motor 43 is driven at a speed which varies with the speed of movement of the webs 12, 14 through the folder sections 20, 30. The compensator roller 24 is thereby moved to a desired position and relative to the other two compensator rollers 23, 25 at a slow rate when the speed of movement of the webs 12, 14 is slow and at a fast rate when the speed of movement of the webs 12, 14 is fast. Thus, the compensator roller 24 is adjusted at a rate which varies with the speed of movement of the webs 12, 14 through the folder sections 20, 30.

By adjusting the position of the compensator roller 24 at a rate which varies with the speed of movement of the webs 12, 14 through the folder sections 20, 30, the lengthwise location of the web 12 of sheet material is controlled for accurate association of its ribbons thus assuring uniform head and tail margins and accurate cutoff.

The structure and operation of the DC motor 44 are the same as the structure and operation of the DC motor 43. Also, as already mentioned hereinabove, the structure and operation of the relay 91 and its associated contact sets 92, 93, 94 are the same as the structure and operation of the relay 81 and its associated contact sets 82, 83, 84. The structure and operation of the relay 95 and its associated contact sets 96, 97, 98 are the same as the structure and operation of the relay 85 and its associated contact sets 86, 87, 88. The DC output power on lines 122, 123 is applied to the motor 44 in the same manner as the DC output power on lines 120, 121 is applied to the motor 43.

When the DC output power on lines 122, 123 is applied to the motor 44, the motor 44 is driven at a speed which varies with the speed of movement of the webs 12, 14 in the same manner that the motor 43 is driven at a speed which varies with the speed of movement of the webs 12, 14. The motor 44 also moves to a desired position at a rate which varies with the speed of movement of the webs 12, 14. Thus, the anglebar 40 also is adjusted at a rate which varies with the speed of movement of the webs 12, 14 through the folder sections 20, 30.

The structure and operation of the DC motor 45 are also the same as the structure and operation of the DC motor 43 and the structure and operation of the DC motor 44. The relays and the contact sets associated with the DC motor 45 are not shown in FIG. 2. The DC output power on lines 124, 125 is applied to the motor 45 in the same manner as the DC output power on lines 120, 121 is applied to the motor 43 and in the same manner as the DC output power on lines 122, 123 is applied to the motor 44.

When the DC output power on lines 124, 125 is applied to the motor 45, the motor 45 is also driven at a speed which varies with the speed of movement of the webs 12, 14. The motor 45 moves to a desired position at a rate which varies with the speed of movement of the webs 12, 14. Thus, the anglebar 41 also is adjusted at a rate which varies with the speed of movement of the webs 12, 14 through the folder sections 20, 30.

The compensator roller 34 in the folder section 30 is controlled and operates in the same way that the compensator roller 24 in the folder section 20 is controlled and operates. Also, the anglebars 50, 51 in the folder section 30 are controlled and operate in the same way that the anglebars 40, 41 in the folder section 20 are controlled and operate.

It is contemplated that it may be desirable in some situations to energize all DC motors at one time or a plurality of DC motors at one time. The energization of all DC motors at one time may be accomplished by programming the computer 100 so that all relays in the relay assembly 80 are energized in response to certain signals. The energization of only certain CD motors at one same time may be accomplished by programming the computer 100 so that only certain relays in the relay assembly 80 are energized. Only those DC motors associated with the certain energized relays will be energized.

Further, it is contemplated that it may be desirable to include provisions to permit a person to manually press a button to select operation of any one or all of the DC motors as the person sees fit. Although each of the web position sensors 46, 47, 56, 57, provides an adjustment control signal indicating that the associated anglebar and/or the associated compensator roller should be adjusted, it is contemplated that it may be desirable to include provisions, such as an adjustable knob or a switch, to permit a person to manually select an adjustment control signal as the person sees fit.

This invention has been described with reference to a preferred embodiment. Modifications and alternations may become apparent to one skilled in the art upon reading and understanding the specification. It is intended to include all such modifications and alterations within the scope of the appended claims.

Having described a specific embodiment of the present invention the following is claimed:

1. An apparatus for adjusting the position of one of an anglebar and a compensator roller both of which guide a moving web of sheet material in a folder of a printing press, said apparatus comprising:

a first motor having an output shaft operatively connected with one of the anglebar and the compensator roller to, when driven, adjust the position of one of the anglebar and the compensator roller;

means for providing a speed reference signal indicative of the speed of movement of the web of sheet material relative to one of the anglebar and the compensator roller;

means for providing an adjustment control signal indicating that one of the anglebar and the compensator roller should be adjusted; and motor control means responsive to said speed reference signal and said adjustment control signal for driving said first motor at a speed which varies with said speed of movement of the web of sheet material.

2. An apparatus as defined in claim 1 wherein said first motor adjusts the position of a compensator roller, and said motor control means controls said first motor to provide an increasing speed of adjustment of the compensator roller from one position to another position as said speed of movement of the web of sheet material increases.

3. An apparatus as defined in claim 1 wherein said first motor adjusts the lengthwise position of an anglebar, and said motor control means controls said first motor to provide an increasing speed of adjustment of the anglebar from one position to another position as said speed of movement of the web of sheet material increases.

4. An apparatus as defined in claim 1 further comprising a second motor having an output shaft operatively connected with another compensator roller to, when driven, adjust the position of the another compensator roller and means for providing an adjustment control signal indicating that the another compensator roller should be adjusted, said motor control means being responsive to said speed reference signal and said adjustment control signal of the another compensator roller for driving said second motor at a speed which varies with said speed of movement of the web of sheet material.

5. An apparatus as defined in claim 4 wherein said motor control means includes DC drive means and relay logic means which controls application of DC output power from said DC drive means to said first and second motors.

6. An apparatus as defined in claim 5 wherein said motor control means includes a computer which controls said DC drive means in response to said speed reference signal and said adjustment control signals.

7. An apparatus as defined in claim 1 wherein said means for providing said speed reference signal is a tachometer operatively connected to the printing press.

8. An apparatus as defined in claim 1 wherein said means for providing said adjustment control signal is a web position sensor.

* * * * *